United States Patent [19]

Kanno et al.

[11] Patent Number: 4,561,404

[45] Date of Patent: Dec. 31, 1985

[54] FUEL INJECTION SYSTEM FOR AN ENGINE

[75] Inventors: Yoshiaki Kanno, Hyogo; Tadataka Nakazumi, Hiroshima, both of Japan

[73] Assignees: Mitsubishi Denki Kabushiki Kaisha, Tokyo; Mazda Motor Corporation, Hiroshima, both of Japan

[21] Appl. No.: 649,757

[22] Filed: Sep. 12, 1984

[30] Foreign Application Priority Data

Sep. 16, 1983 [JP] Japan ..... 58-171900

[51] Int. Cl.[4] ..... F02D 5/02

[52] U.S. Cl. ..... 123/492; 123/494

[58] Field of Search ..... 123/492, 494, 478

[56] References Cited

U.S. PATENT DOCUMENTS 4,221,191 9/1980 Asano et al. ..... 123/492

4,266,522 5/1981 Williams et al. ..... 123/492

4,356,803 11/1982 Miyagi ..... 123/494

4,437,446 3/1984 Isomura et al. ..... 123/492

4,471,743 9/1984 Watanabe ..... 123/492

4,490,792 12/1984 Deutsch et al. ..... 123/492

4,499,881 2/1985 Takano ..... 123/492

*Primary Examiner*—Raymond A. Nelli

*Attorney, Agent, or Firm*—Murray, Whisenhunt and Ferguson

[57] ABSTRACT

Opening degree of the throttle valve of an engine is detected and compared with a plurality of throttle opening degree reference values which are preset to be minuter in the lower region of the throttle opening degree. Each time the actual throttle opening degree exceeds one of the reference values, an extra fuel injection pulse is outputted in addition to regular injection pulses to increase the amount of fuel to be supplied to the engine.

5 Claims, 5 Drawing Figures

24
VB
RB
CB
41
32
31
33
34
Rs
R
VB
26e
26d
26c
26b
26a 24
27
PULSE WIDTH
40
LEADING EDGE DETECTION
30
26e
26d
26c
26b
26a

FUEL INJECTION SYSTEM FOR AN ENGINE

BACKGROUND OF THE INVENTION

1. Field of the Invention

This invention relates to a fuel injection system for an engine, and more particularly to an improvement in control of the amount of fuel to be injected during accelerating operation of the engine.

2. Description of the Prior Art

Conventionally, whether or not the engine is accelerated has been detected by detecting change in opening degree of a throttle valve provided in the intake passage of the engine, or by detecting change in intake vacuum in the intake passage downstream of the throttle valve. It has been proposed to supply an increased amount of fuel to the engine during accelerating operation of the engine thus detected by increasing the width of individual regular injection pulses or outputting a plurality of extra injection pulses of the same width. See Japanese Unexamined Patent Publication 57(1982)-143135, for example.

By the way, due to the shape of the throttle valve which is a so-called butterfly valve, change in the amount of intake air for a given amount of displacement of the throttle valve varies with the opening degree of the throttle valve. That is, the smaller the opening degree of the throttle valve is (i.e., the lighter the load on the engine is the larger the change in the amount of intake air for a given amount of displacement of the throttle valve is.

Thus there has been proposed to increase detection sensitivity in detecting engine acceleration or to increase the fuel increasing rate during accelerating operation of the engine as the load on the engine is reduced. However these proposal are disadvantageous in that complicated structure is required. Particularly, in order to accomplish both the proposals together with each other, very complicated structure is required.

SUMMARY OF THE INVENTION

In view of the foregoing observations and description, the primary object of the present invention is to provide an improved fuel injection system for an engine which is very simple in structure and is capable of detecting engine acceleration with an increased sensitivity as the load on the engine is reduced and as well as increasing the increasing rate of fuel during accelerating operation of the engine as the load on the engine reduced.

In accordance with the present invention, a plurality of throttle opening degree reference values are preset, and each time the actual throttle opening degree exceeds one of the reference values, an extra injection pulse is outputted independent of regular injection pulses to increase fuel to be supplied to the engine. The reference values are more minutely preset in the lower region of the throttle opening degree.

By setting the reference values more minutely in the lower region of the throttle opening degree than the higher region of the same, engine acceleration can be detected more quickly when the engine is accelerated with the throttle valve opening degree being increased from the lower region and at the same time the fuel increasing rate can be increased in the lower region of the throttle opening degree, whereby fuel increasing control during accelerating operation of the engine can be effected according to the changing characteristics of the amount of intake air with respect to the throttle opening degree with a very simple structure.

That is, the fuel injection system of the present invention comprises signal detecting means for detecting an air-amount signal directly or indirectly representing the amount of intake air, fundamental fuel injection amount calculating means for calculating fundamental fuel injection amount according to the amount of intake air represented by the air-amount signal, regular injection pulse generating means for outputting a regular injection pulse corresponding to the fundamental fuel injection amount determined by the fundamental fuel injection amount calculating means to a fuel injection valve according to a predetermined timing, throttle opening degree detecting means for detecting the opening degree of the throttle valve, reference value setting means for setting a plurality of throttle opening degree reference values, comparator means for comparing a throttle opening degree signal from the throttle opening degree detecting means with the plurality of throttle opening degree reference values, and acceleration determination means which outputs an extra injection pulse to the fuel injection valve each time the comparator means determines that the throttle opening degree exceeds one of the throttle opening degree reference values, and is characterized in that said reference value setting means sets the throttle opening degree reference values to the minuter in the lower region of the throttle opening degree, whereby the lighter the load on the engine is, i.e., the lower the throttle opening degree region is during accelerating operation of the engine, the more extra injection pulses are outputted in addition to the regular injection pulses, i.e., the more the fuel increasing rate is.

DESCRIPTION OF THE PREFERRED EMBODIMENT

Figure 1:
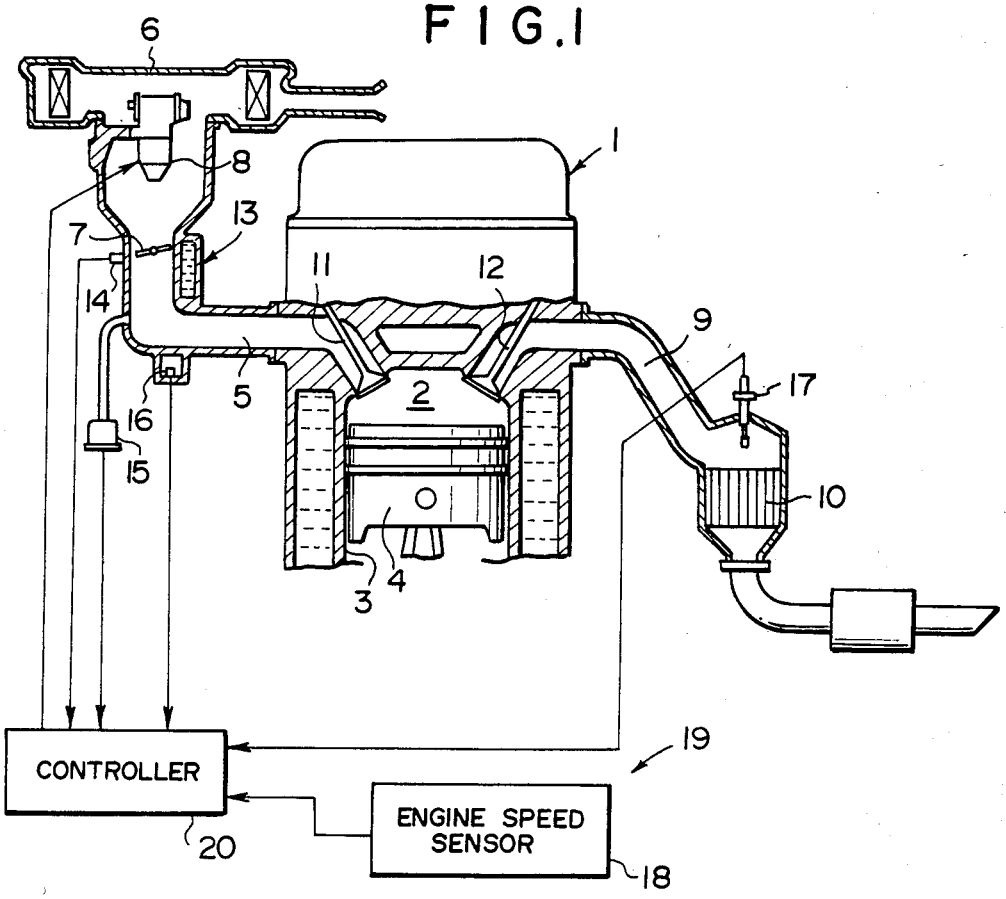
FIG. 1 is a schematic view showing an engine employing a fuel injection system in accordance with an embodiment of the present invention.

In FIG. 1, reference numerals 1 and 2 respectively denote an engine and a combustion chamber formed between a cylinder 3 formed in the engine 1 and a piston 4 slidably fit into the cylinder 3. The engine 1 is provided with an intake passage 5 which opens to the atmosphere by way of an air cleaner 6 at one end and to the combustion chamber 2 at the other end. A throttle valve 7 for controlling the amount of intake air is provided in the intake passage 5 and a fuel injection valve 8 for injecting fuel into the intake passage 5 is provided upstream of the throttle valve 7. An exhaust passage 9 opens to the combustion chamber 2 at one end and to the atmosphere at the other end. A catalytic converter 10 is provided in the exhaust passage 9. Reference numerals 11 and 12 respectively denote an intake valve and an exhaust valve. The engine 1 is further provided with an intake air heating system 13 for heating the intake passage 5 downstream of the throttle valve 7 by heat of engine cooling water.

The engine 1 is further provided with a throttle opening degree sensor 14 for detecting the opening degree of the throttle valve 7, a vacuum sensor 15 for detecting intake vacuum in the intake passage 5 downstream of the throttle valve 7, a cooling water temperature sensor 16 for detecting the temperature of cooling water in the intake air heating system 13, an air-fuel ratio sensor 17 which is an $O_2$ sensor disposed in the exhaust passage 9 upstream of the catalytic converter 10 to detect air-fuel ratio by way of the oxygen concentration in exhaust gas, and an engine speed sensor 18 for detecting the engine rpm. The vacuum sensor 15 and the engine speed sensor 18 form signal detecting means 19 for detecting an air-amount signal representing the amount of intake air. Signals from the sensors 14 to 18 are inputted into a controller 20 for controlling the fuel injection valve 8.

Figure 2:
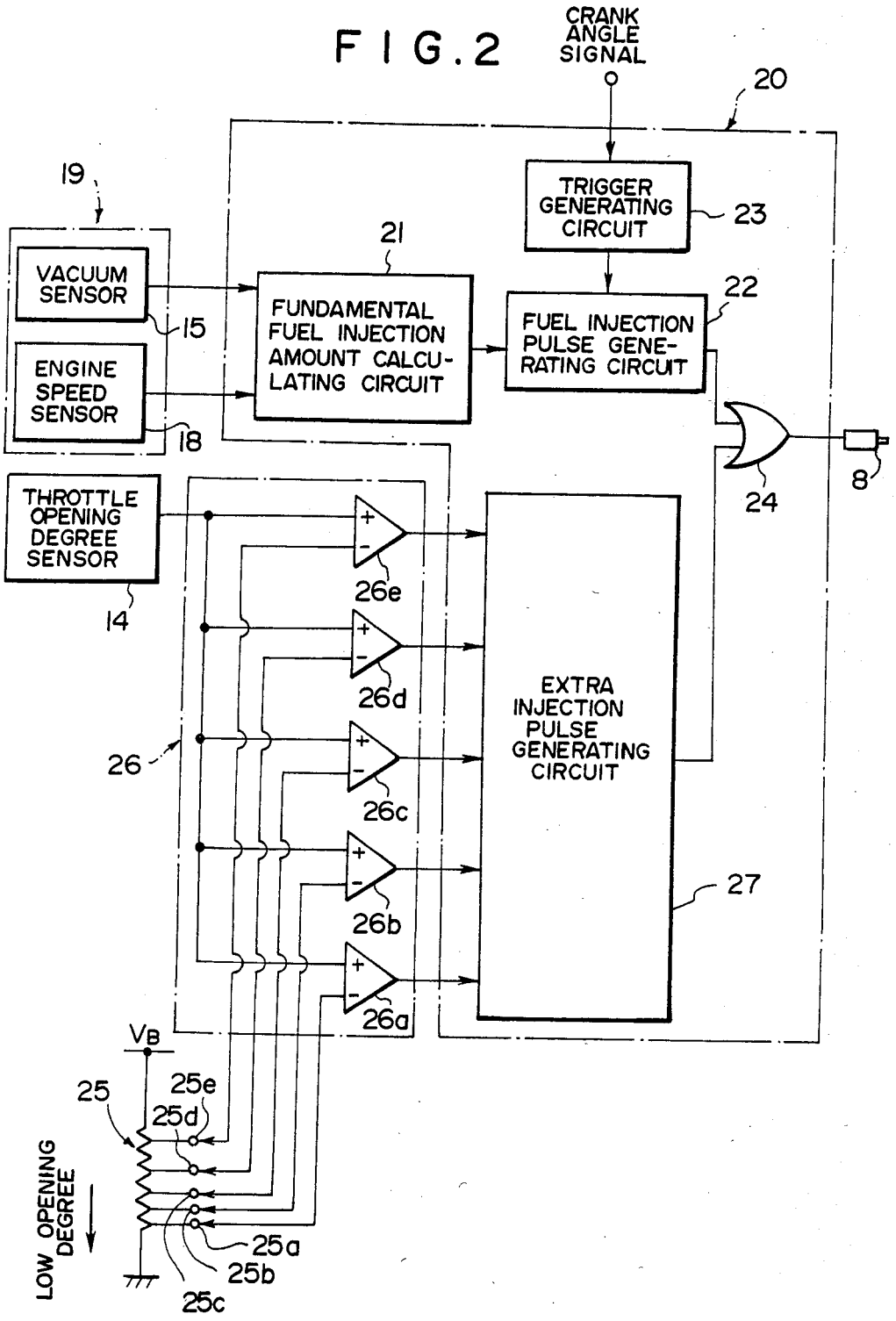
FIG. 2 is a block diagram showing the circuitry of the fuel injection system of FIG. 1.

As shown in FIG. 2, the controller 20 includes a fundamental fuel injection amount calculating circuit 21 and a regular injection pulse generating circuit 22. The fundamental fuel injection amount calculating circuit 21 receives the air-amount signal (that is, the vacuum signal from the vacuum sensor 15 and the rpm signal from the engine speed sensor 18) from the signal detecting means 19, and calculates a fundamental fuel injection amount based on the amount of intake air represented by the air-amount signal. The regular injection pulse generating circuit 22 receives a fundamental fuel injection amount signal from the fundamental fuel injection amount calculating circuit 21 to generate a regular injection pulse having a width corresponding to the amount of fuel to be injected, and delivers it to the fuel injection valve 8 by way of an OR circuit 24 each time it receives a trigger signal generated from a trigger generating circuit 23 in synchronization with engine speed, for example. The trigger generating circuit 23 generates the trigger signal in response to a crank angle signal, for example.

A resistor 25 forming said reference value setting means has a plurality (five in this particular embodiment) of taps 25*a* to 25*e*. The voltage between the ends of the resistor 25 represents full opening of the throttle valve 7, and the voltages at the respective tap 25*a* to 25*e* represent a plurality of throttle opening degree reference values S1 to S5.

Figure 3:
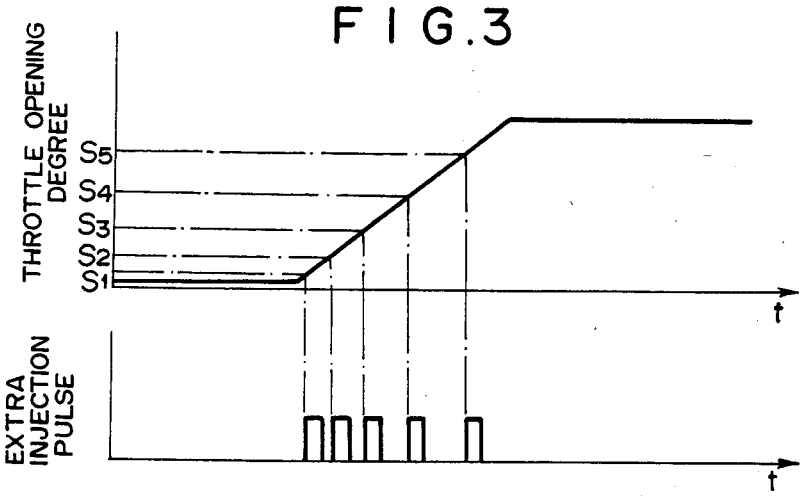
FIG. 3 is a view for illustrating the operation of the fuel injection system of FIG. 1.

A comparing circuit 26 has five comparators 26*a* to 26*e*. To the positive terminals of the respective comparators 26*a* to 26*e* is inputted a throttle opening degree signal from the throttle opening degree sensor 14, and to the negative terminals of the respective comparators 26*a* to 26*e* are respectively connected the taps 25*a* to 25*e*. The comparators 26*a* to 26*e* output high level signals when the throttle opening degree signal inputted thereto is higher than the respective reference values S1 to S5. The reference values S1 to S5 respectively represent five different throttle opening degrees which are low in this order, and as can be understood from the spaces between adjacent taps (25*a* to 25*e*) in FIG. 2 and from FIG. 3, the differences between adjacent reference values S1 to S5, (the differences between S1 and S2, S2 and S3, S3 and S4, and S4 and S5) are small in this order. Thus, the lower the throttle opening degree region is, the more comparators (26*a* to 26*e*) output the high level signal for a given displacement of the throttle valve 7.

The output of each comparator is inputted into an extra injection pulse generating circuit 27 which generates an extra injection pulse of a predetermined width each time it receives a high level signal from the comparators 26*a* to 26*e*. The extra injection pulse is delivered to the fuel injection valve 8 by way of the OR circuit 24. Thus, fuel supplied to the engine 1 during acceleration thereof is increased by a larger rate when the throttle opening degree is low than when the throttle opening degree is high.

Figure 5:
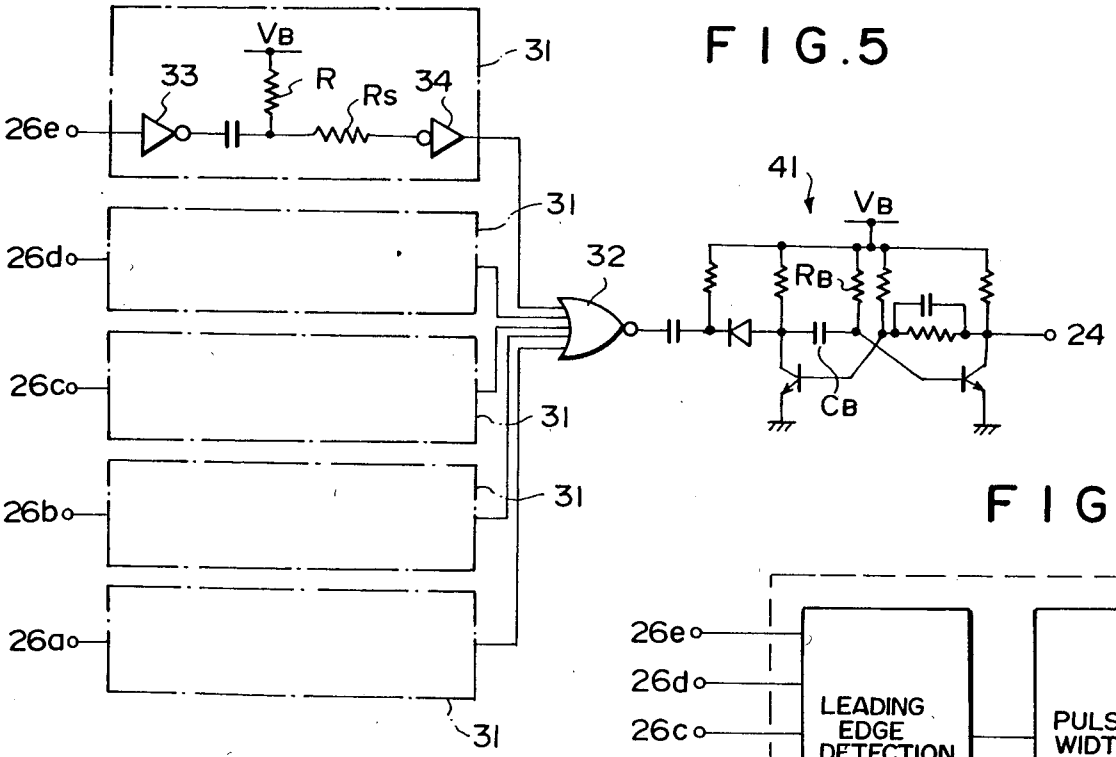
FIG. 5 is a concrete example of the extra injection pulse generating circuit shown in FIG. 4.
Figure 4:
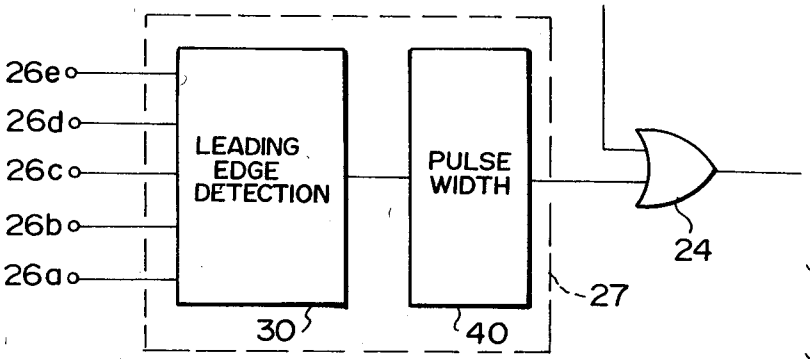
FIG. 4 is a block diagram showing an example of the extra injection pulse generating circuit employed in the fuel injection system of FIG. 1.

The extra injection pulse generating circuit 27 may comprise a leading edge detecting circuit 30 which detects the leading edge of the pulse generated from the comparators 26*a* to 26*e* and outputs a short pulse, and a pulse width generating circuit 40 which receives the short pulse from the leading edge detecting circuit 30 and outputs a pulse having a predetermined width as shown in FIG. 4. The leading edge detecting circuit 30 may comprise a plurality (five in this particular embodiment) of differentiating circuits 31 respectively connected to the comparators 26*a* to 26*e*, differentiating circuits 31 are inputted, and the pulse width generating circuit 40 may comprise a monostable multivibrator 41 as shown in FIG. 5. Each differentiating circuit 31 is provided with a pair of inverters 33 and 34, and when a high level signal is inputted into the inverter 33, a positive trigger pulse is outputted from the inverter 34 as will be apparent to those skilled in the art. The positive trigger pulse is inverted by the inverted OR (NOR) circuit 32 and the resulting negative trigger pulse is inputted into the monostable multivibrator 41. When the negative trigger pulse is inputted into the monostable multivibrator 41, a positive pulse having a width determined by a time-constant determined by a resistor RB and a capacitor CB in the input stage of the monostable multivibrator 41 is outputted to the OR circuit 24.

Though in the above embodiment, the throttle opening degree reference value setting means (the resistor 25) and the comparator means (the comparing circuit 26) are in the form of an analogue circuit, they may be in the form of a digital circuit. Further, though the signal detecting means is formed of the vacuum sensor 15 and the engine speed sensor 16 in the above embodiment, it may be formed of, for instance, an airflow meter which is disposed in the intake passage upstream of the throttle valve 7 to directly detect the amount of intake air.

We claim:

1. A fuel injection system for an internal combustion engine comprising, a signal detecting means for detecting one of a direct and indirect signal representative of the amount of intake air, a fundamental fuel injection amount calculating means for calculating a fundamental fuel injection amount in accordance with the amount of intake air represented by one of said direct and indirect signal, a first trigger signal generating means for generating a first trigger representative of a predetermined timing, a regular injection pulse generating means for generating and outputting a regular injection pulse corresponding to said fundamental fuel injection amount determined by said fundamental fuel injection amount calculating means to an injection pulse generating circuit means each time said first trigger signal is generated, a throttle opening degree detecting means for detecting an opening degree of a throttle valve and generating an actual throttle opening degree signal, a reference value setting means for setting a predetermined plurality of the throttle opening degree reference values, a comparator means for comparing an actual throttle opening degree represented by said throttle opening degree signal from said throttle opening degree detecting means, a second trigger signal generating means for generating a second trigger signal each time said actual throttle opening degree signal rises above one of said predetermined plurality of throttle opening degree reference values, a supplemental injection pulse generating means for generating extra injection pulses each time said second trigger signal is generated, a fuel injection valve disposed in the intake passage of said engine and responsive to be driven by one of said regular injection pulse and said extra injection pulse to inject fuel into said intake passage, said throttle opening degree reference values being set such that said reference values are at smaller intervals in the lower region of the throttle opening degree.

2. A fuel injection system as defined in claim 1 in which said signal detecting means comprises a vacuum sensor for detecting intake vacuum in the intake passage downstream of the throttle valve, and an engine speed sensor for detecting the engine rpm.

3. A fuel injection system as defined in claim 1 in which said first trigger signal generating means outputs the first trigger signal in synchronization with revolution of the engine.

4. A fuel injection system as defined in claim 1 in which said fuel injection valve is disposed in the intake passage upstream of the throttle valve.

5. A fuel injection system as defined in claim 1 in which said extra injection pulse generating means generates extra injection pulses having substantially the same pulse width when the actual throttle opening degree exceeds the respective throttle opening degree reference values.

* * * * *